US008454301B1

(12) United States Patent
Liang

(10) Patent No.: US 8,454,301 B1
(45) Date of Patent: Jun. 4, 2013

(54) TURBINE BLADE WITH SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 862 days.

(21) Appl. No.: 12/820,220

(22) Filed: Jun. 22, 2010

(51) Int. Cl.
*F04D 31/00* (2006.01)

(52) U.S. Cl.
USPC ..... 415/116; 416/97 R

(58) Field of Classification Search
USPC ..... 416/96 R, 97 R, 95; 415/115, 116
See application file for complete search history.

(56) References Cited

U.S. PATENT DOCUMENTS 6,966,756 B2 * 11/2005 McGrath et al. ..... 416/97 R
7,674,093 B2 * 3/2010 Lee et al. ..... 416/97 R

* cited by examiner

*Primary Examiner* — Edward Look
*Assistant Examiner* — Christopher C Williams
(74) *Attorney, Agent, or Firm* — John Ryznic

(57) ABSTRACT

A turbine rotor blade with an aft flowing 5-pass serpentine flow cooling circuit in which a first metering hole connect a first root turn formed between the second and third legs to a core support cavity and a second metering hole connects the core support cavity to a second root turn formed between the fourth and fifth legs so that cooling air from the second leg can be discharged directly into the fifth leg while bypassing the third and fourth legs. A seal pin can be secured within the core support cavity to block the bypass cooling flow.

11 Claims, 6 Drawing Sheets

TURBINE BLADE WITH SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to turbine rotor blade with serpentine flow cooling.

2. Description of the Related Art including information disclosed under 37 CFR 1.97 and 1.98

A gas turbine engine, such as a large frame heavy duty industrial gas turbine (IGT) engine, includes a turbine with one or more rows of stator vanes and rotor blades that react with a hot gas stream from a combustor to produce mechanical work. The stator vanes guide the hot gas stream into the adjacent and downstream row of rotor blades. The first stage vanes and blades are exposed to the highest gas stream temperatures and therefore require the most amount of cooling.

The efficiency of the engine can be increased by using a higher turbine inlet temperature. However, increasing the temperature requires better cooling of the airfoils or improved materials that can withstand these higher temperatures. Turbine airfoils (vanes and blades) are cooled using a combination of convection and impingement cooling within the airfoils and film cooling on the external airfoil surfaces.

FIG. 1 shows a blade external heat transfer coefficient (HTC) profile for a first stage turbine rotor blade in an industrial gas turbine engine. As seen in FIG. 1, the airfoil leading edge and trailing edge as well as a forward region of the suction side surface experiences high hot gas heat transfer coefficient while the mid-chord section of the airfoil is at a lower hot gas HTC. Thus, the hottest parts of the first stage blade are on the leading and trailing edges and on the suction side wall just downstream from the leading edge region.

FIG. 2 shows a prior art turbine rotor blade with a 5-pass serpentine flow aft flowing cooling circuit, FIG. 3 shows a cross section view along a radial line of the FIG. 2 blade cooling circuit and FIG. 4 shows a flow diagram for the blade cooling circuit for the FIG. 2 blade. The first leg of the 5-pass serpentine circuit is located at the leading edge to provide cooling for this section. The last and fifth leg is located along the trailing edge region and is connected to a row of trailing edge exit slots that provide cooling for the trailing edge region of the blade. No film cooling holes are sued in the FIG. 2 blade and therefore all of the cooling air that flows into the first leg eventually flows into the last leg to be discharged out through the exit slots.

One major problem with the FIG. 1 design is that the fresh cooling air passing through the first leg is heated and then passed through the next three legs in the airfoil mid-chord region before passing along the last leg in the trailing edge region. Thus, the cooling air to be used in the trailing edge region is heated up more than necessary and the airfoil mid-chord region is over-cooled because the cooling air from the first leg passes through the mid-chord region before passing through the trailing edge region. The over-heated cooling air used for the T/E region will induce hot spots in the T/E metal temperature which will cause erosion damage and thus a shortened blade life, especially for an engine like an IGT engine that requires continuous operating periods of over 40,000 hours before shutdown.

In order to over-come some of the over-heating of the T/E region and over-cooling of the airfoil mid-chord region described in the FIG. 1 blade, a redistribution of cooling air within the 5-pass serpentine flow cooling circuit is required. U.S. Pat. No. 6,139,269 issued to Liang on Oct. 31, 2000 and entitled TURBINE BLADE WITH MULTI-PASS COOLING AND COOLING AIR ADDITION discloses a blade with a 5-pass forward flowing serpentine cooling circuit with cooling air addition in turns between the second and third legs and between the fourth and fifth legs to resupply the serpentine circuit with cooler fresh cooling air in the airfoil mid-chord region.

U.S. Pat. No. 6,340,047 issued to Frey on Jan. 22, 2002 and entitled CORE TIED CAST AIRFOIL discloses a blade with a 5-pass aft flowing serpentine flow cooling circuit in which fresh cooling air from the root is injected into the turns between the second and third legs and between the fourth and fifth legs through ball braze holes. U.S. Pat. No. 6,966,756 issued to McGrath et al. on Nov. 22, 2005 and entitled TURBINE BUCKET COOLING PASSAGES AND INTERNAL CORE FOR PRODUCING THE PASSAGES and U.S. Pat. No. 7,674,093 issued to Lee et al on Mar. 9, 2010 and entitled CLUSTER BRIDGED CASTING CORE discloses similar fresh cooling air resupply passages for a serpentine flow cooling circuit within a blade that use ball braze holes to close out the ceramic core support holes.

BRIEF SUMMARY OF THE INVENTION

The cooling circuit for the turbine rotor blade can provide a serpentine flow cooling circuit for use in a turbine airfoil cooling design, especially for the blade cooling design that emphasize on a uniform metal temperature distribution and requires cooling flow addition to lower the last up-pass leg cooling air temperature for the trailing edge region of the airfoil. Also, the cooling circuit will simplify the manufacture process by eliminating the ball braze steps.

The blade includes an aft flowing 5-pass serpentine flow cooling circuit with two metering holes located at the blade root turns between the second and third legs and between the fourth and fifth legs so that some of the cooling air from the end of the second leg can be delivered directly into the beginning of the fifth leg without having to pass through the third and fourth legs. Both of the two metering holes are connected to a spanwise cavity in the blade root section. The spanwise cavity in conjunction with the metering holes is used to position the mid-chord serpentine flow channels during the casting manufacture process of the blade.

In a case where there is no need for cooling flow addition, a pin can be inserted through the spanwise cavity to block the by-pass cooling flow from the leading edge flow channel into the trailing edge flow channel. A straight aft flowing 5-pass serpentine flow cooling circuit is retained with the pin in place.

DETAILED DESCRIPTION OF THE INVENTION

The turbine rotor blade of the present invention is shown in FIGS. 5-8 and can be used in an IGT engine or an aero engine. A blade used in an IGT engine will require long periods of operation without engine shutdown, and therefore the present invention is more applicable to the IGT blade because of the improved cooling effectiveness in controlling metal temperature to prevent hot spots that can lead to erosion damage of the blade and therefore shortened life or a decrease in the engine efficiency due to operating with a damaged part.

Figure 1:
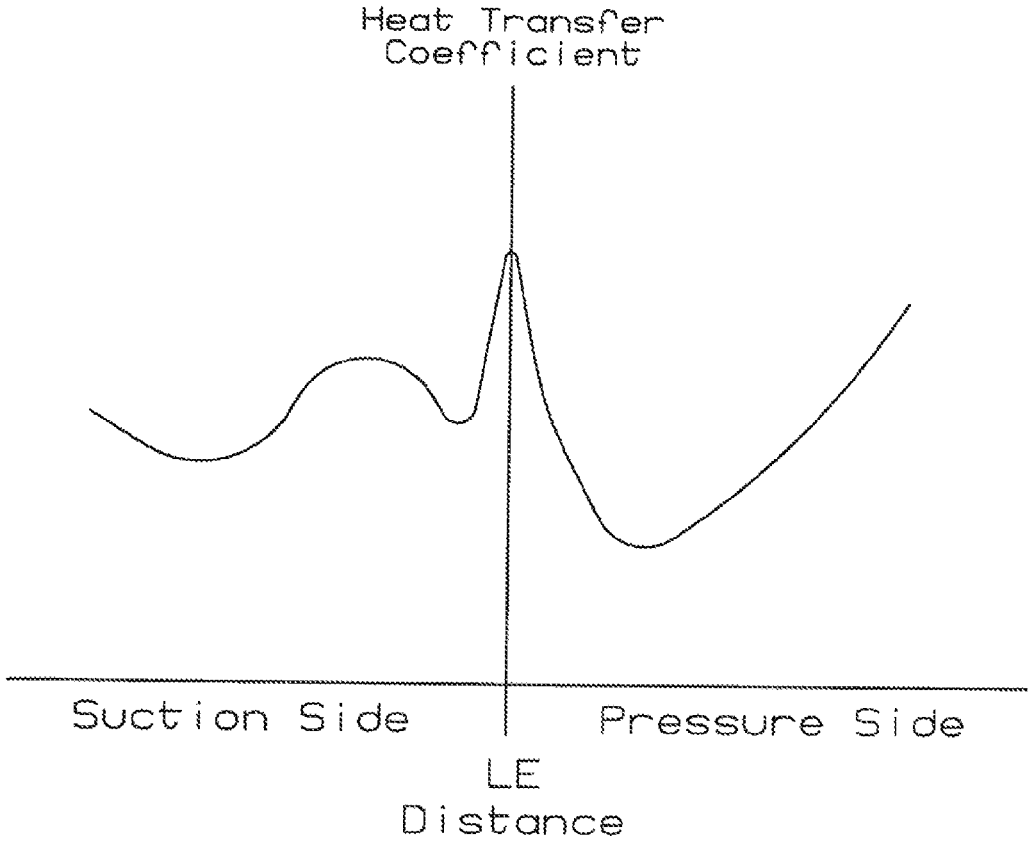
Fig 1 prior art
FIG. 1 shows a graph of an airfoil external heat transfer coefficient (HTC) distribution for a first stage turbine rotor blade in an industrial gas turbine engine.
Figure 2:
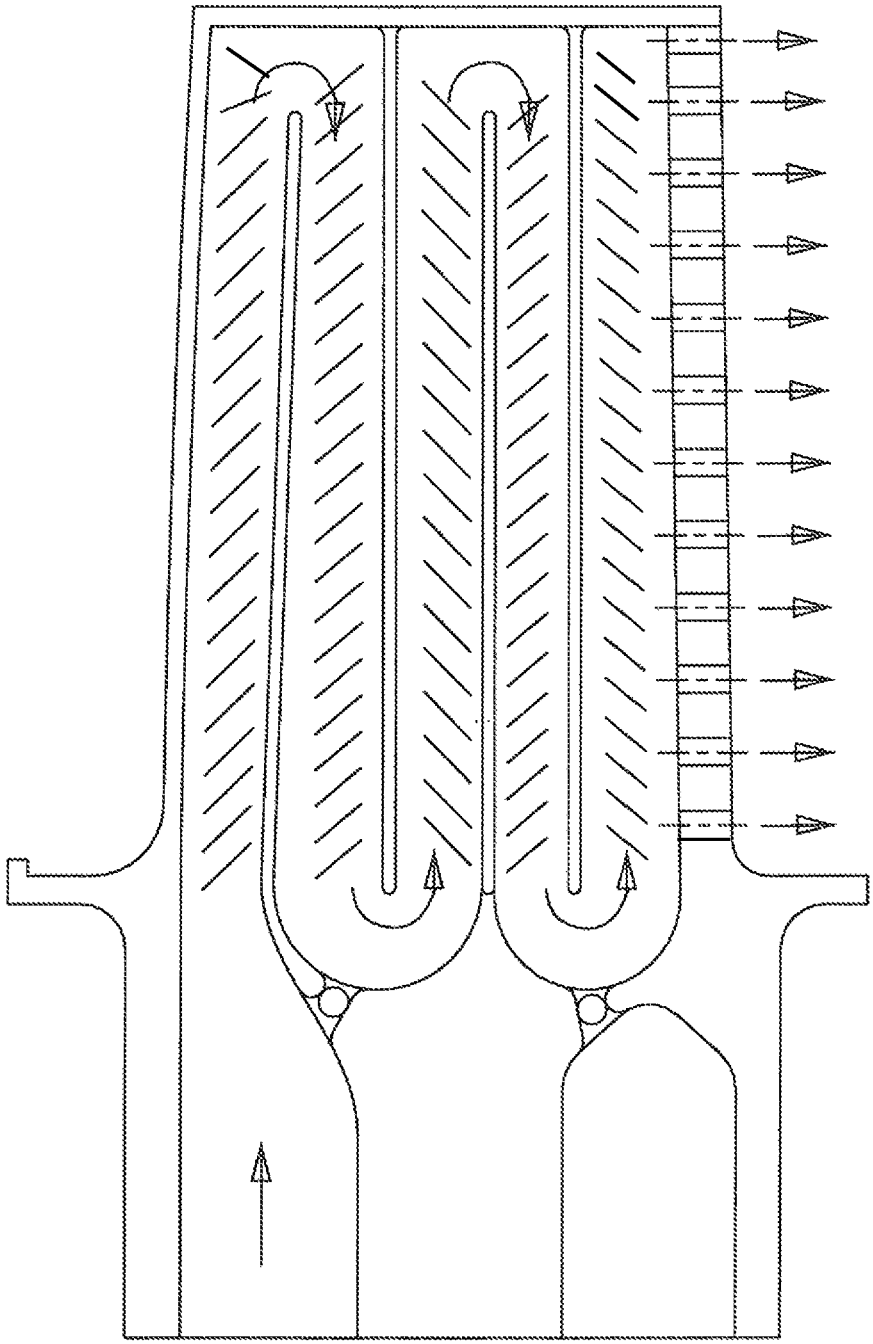
Fig 2 prior art
FIG. 2 shows a cross section side view of a prior art turbine rotor blade with a 5-pass serpentine flow cooling circuit.
Figure 3:
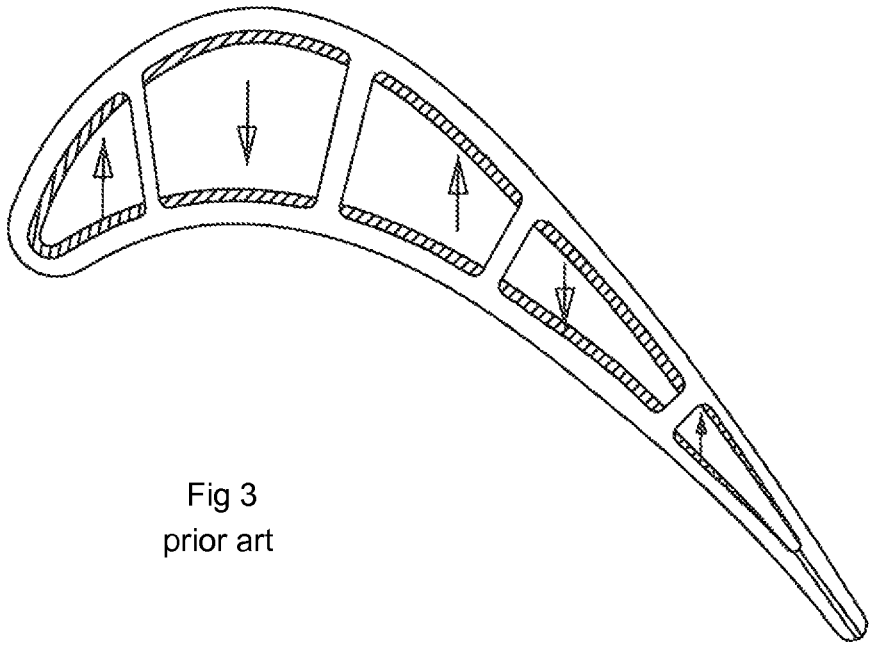
Fig 3 prior art
FIG. 3 shows a cross section cut view of the prior art blade in FIG. 2.
Figure 4:
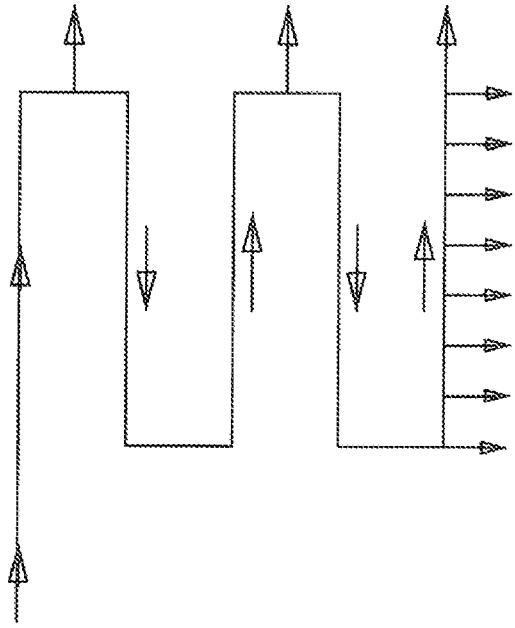
Fig 4 prior art
FIG. 4 shows a flow diagram for the prior art blade of FIG. 2.
Figure 5:
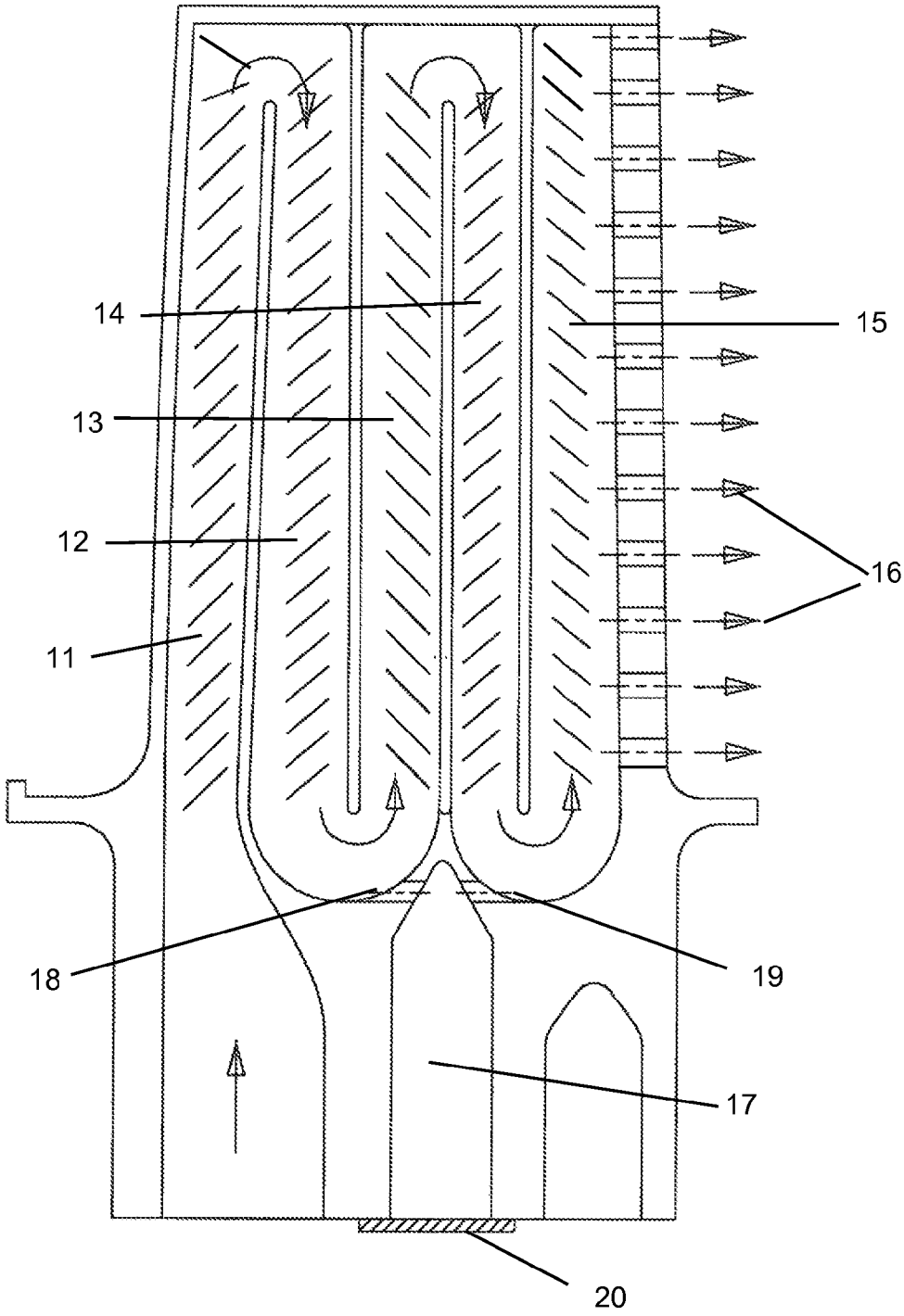
FIG. 5 shows a cross section side view of the blade cooling circuit of the present invention.

FIG. 5 shows the blade with a 5-pass aft flowing serpentine flow cooling circuit with a first leg 11 located along the leading edge and a fifth and last leg 15 located along a trailing edge region that is connected to a row of exit slots 16 on the trailing edge of the airfoil. The second, third and fourth legs (12, 13, 14) of the 5-pass serpentine flow circuit are connected between the first leg 11 and the fifth leg 15.

As seen in FIG. 5, a the bottom of the down turns between the second and third legs 12 and 13 and between the fourth and fifth legs 14 and 15 are two metering holes with a first metering hole 18 located in the second and third legs 12 and 13 turn and a second metering hole 19 located in the fourth and fifth legs 14 and 15 turn. The first and second metering holes 18 and 19 are at the bottom of the turns so that the metering holes are flush with the bottom of the turns. The first metering hole 18 is also formed inline with the second metering hole 19. Both the first and second metering holes 18 and 19 are connected to a core support cavity or spanwise cavity 17 in the blade root or attachment section. A cover plate 20 is used to close off the spanwise cavity 17 where the two metering holes 18 and 19 are used for cooling air resupply. The spanwise cavity 17 in conjunction with the two metering holes 18 and 19 are used to position the mid-chord serpentine flow channels during the casting manufacture process.

Figure 6:
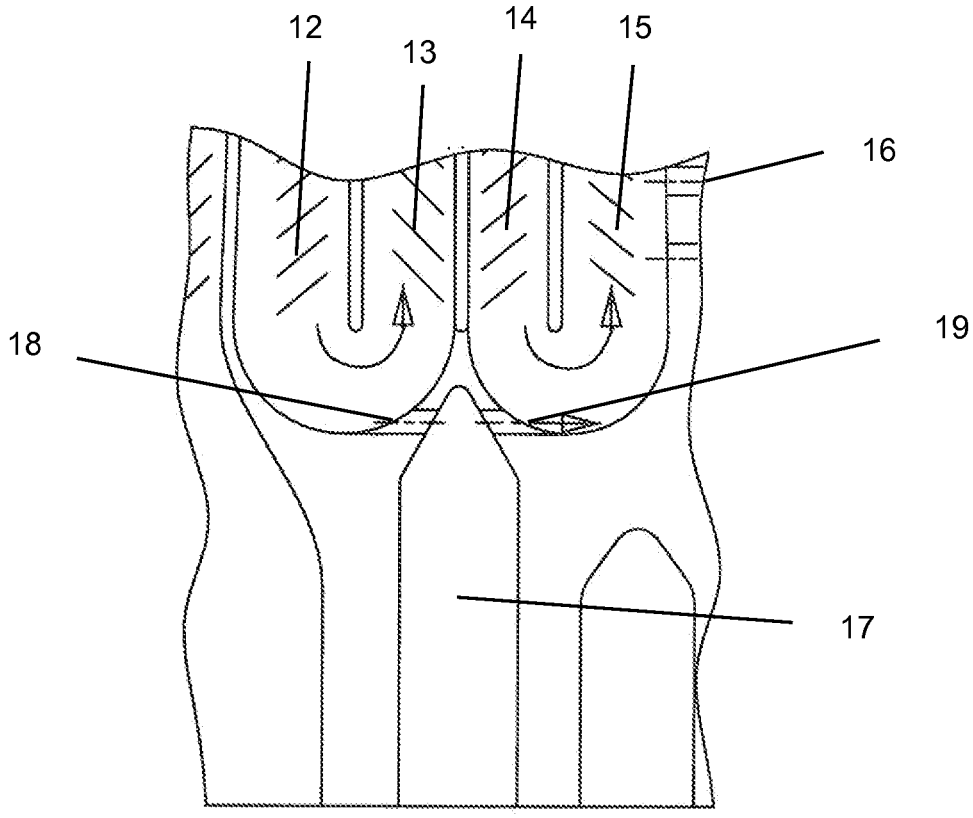
FIG. 6 shows a detailed view of the core support and seal pin with an end plate used in the blade with the cooling circuit of the present invention.
Figure 7:
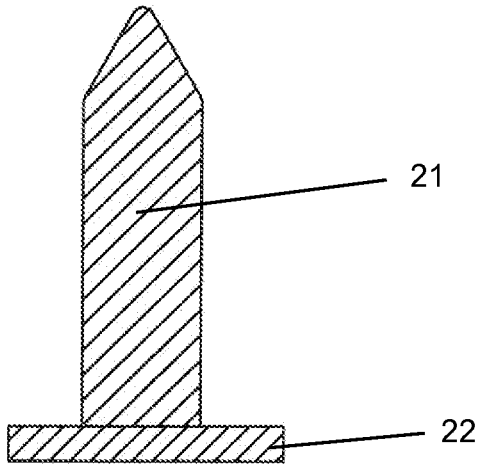
FIG. 7 shows a cross section view of the seal pin with end plate used in the blade of the present invention.
Figure 8:
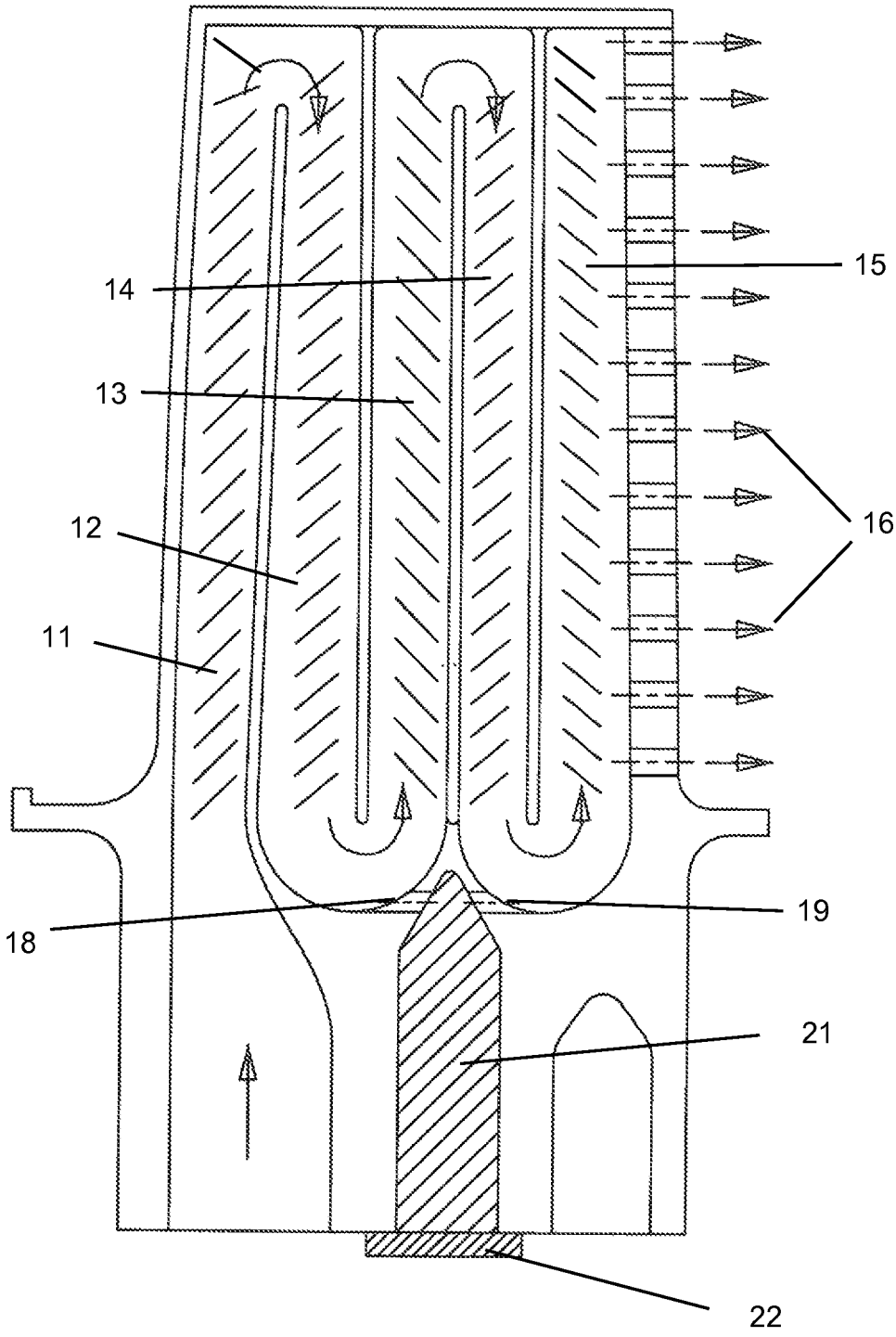
FIG. 8 shows a cross section side view of the blade of the present invention with the seal pin inserted into position within the serpentine flow cooling circuit of the present invention.

FIG. 6 shows a detailed view of the two metering holes 18 and 19 and the spanwise cavity 17. The spanwise cavity 17 is pointed at the top end where the two metering holes 18 and 19 open into the spanwise cavity 17. FIG. 7 shows the seal pin 21 with the end plate 22 that is used to block or disable the two metering holes 18 and 19 when the insert 21 is placed within the spanwise cavity 17 as is shown in FIG. 8. When the seal pin 21 is inserted into the spanwise cavity, the end plate 22 will position the pointed end of the seal pin into the pointed end of the spanwise cavity 17 so that the tip or pointed end of the seal pin 21 will block off the two metering holes 18 and 19 so that no flow will occur.

In operation, the cooling air with additional added cooling flow is supplied through the airfoil leading edge serpentine flow channel and serpentines down through the first down pass (the second leg) where the airfoil heat load is high. Since the heat load for the airfoil mid-chord region is lower than in the leading edge region, less cooling air is required in the mid-chord region. A portion of the cooling air is bled off from the second leg at the root turn and through the first metering hole, into the open spanwise cavity 17 and then through the second metering hole 19 and into the beginning of the fifth leg 15. This injected cooling air will be inline with the direction off the cooling air flow in the root turn from the fourth leg. This cooling flow management eliminates the over-cooling of the airfoil mid-chord region and the cooling air heat up from the over-cooling of the mid-chord region which yields a better cooling potential for the trailing edge cooling. The spent cooling air is then discharged along the trailing edge of the airfoil to provide cooling for this portion of the airfoil. A well thermally balanced airfoil cooling design is therefore achieved.

In the case where there is no need for cooling flow addition, the seal pin 21 can be inserted through the spanwise cavity 17 to block off the by-pass cooling flow through the two metering holes 18 and 19 and form a straight aft flowing 5-pass serpentine flow cooling circuit.

I claim the following:

1. A turbine rotor blade comprising:

an airfoil extending from a platform and a root;

a 5-pass serpentine flow cooling circuit formed within the airfoil;

a core support cavity formed within the root and extending in a spanwise direction between a first root turn between a second leg and a third leg of the serpentine flow cooling circuit and a second root turn between a fourth leg and a fifth leg of the serpentine flow cooling circuit;

a first metering hole connecting the first root turn to the core support cavity;

a second metering hole connecting the core support cavity to the second root turn; and, the first and second metering holes are both tangent to the respective root turn.

2. The turbine rotor blade of claim 1, and further comprising:

the first metering hole is aligned with the second metering hole.

3. The turbine rotor blade of claim 2, and further comprising:

the first metering hole is flush with a bottom of the first root turn; and, the second metering hole is flush with a bottom of the second root turn.

4. The turbine rotor blade of claim 1, and further comprising:

the first metering hole is flush with a bottom of the first root turn; and, the second metering hole is flush with a bottom of the second root turn.

5. The turbine rotor blade of claim 1, and further comprising:

the core support cavity has a pointed upper end in which the first and second metering holes open.

6. The turbine rotor blade of claim 5, and further comprising:

a seal pin having a pointed upper end is inserted into the core support cavity to block cooling air flow through the first and second metering holes.

7. A turbine rotor blade comprising:

an airfoil extending from a platform and a root;

a 5-pass serpentine flow cooling circuit formed within the airfoil;

a core support cavity formed within the root and extending in a spanwise direction between a first root turn between a second leg and a third leg of the serpentine flow cooling circuit and a second root turn between a fourth leg and a fifth leg of the serpentine flow cooling circuit;

a first metering hole connecting the first root turn to the core support cavity; and, a second metering hole connecting the core support cavity to the second root turn; and, a seal pin inserted into the core support cavity to block cooling air flow through the first and second metering holes.

8. The turbine rotor blade of claim 1, and further comprising:

the 5-pass serpentine flow cooling circuit is an aft flowing serpentine circuit with a first leg located along a leading edge of the airfoil and a 1st last leg located along a trailing edge region of the airfoil; and, a row of exit slots along the trailing edge of the airfoil and connected to the last leg of the serpentine flow circuit.

9. The turbine rotor blade of claim 8, and further comprising:

the five legs of the 5-pass serpentine flow cooling circuit along extend from the root to the tip of the blade.

10. A turbine rotor blade comprising:

an airfoil extending from a platform and a root;

a 5-pass serpentine flow cooling circuit formed within the airfoil;

a core support cavity formed within the root and extending in a spanwise direction between a first root turn between a second leg and a third leg of the serpentine flow cooling circuit and a second root turn between a fourth leg and a fifth leg of the serpentine flow cooling circuit;

the core support cavity having a pointed top end;

a first metering hole connecting the first root turn to the core support cavity;

a second metering hole connecting the core support cavity to the second root turn; and, the first and second metering holes opening into the core support cavity at the pointed top end.

11. A turbine rotor blade comprising:

an airfoil extending from a platform and a root;

a 5-pass serpentine flow cooling circuit formed within the airfoil;

a core support cavity formed within the root and extending in a spanwise direction between a first root turn between a second leg and a third leg of the serpentine flow cooling circuit and a second root turn between a fourth leg and a fifth leg of the serpentine flow cooling circuit;

the core support cavity having a pointed top end;

a first metering hole connecting the first root turn to the core support cavity;

a second metering hole connecting the core support cavity to the second root turn; and, an axis of the first metering hole passes through an axis of the second metering hole.

* * * * *